United States Patent [19]

Hallerman

[11] 4,222,560

[45] Sep. 16, 1980

[54] EXERCISER AND REHABILITATIVE GRIPPING DEVICE

[76] Inventor: Edith O. Hallerman, 41-06 Case St., Elmhurst, N.Y. 11373

[21] Appl. No.: 949,178

[22] Filed: Oct. 6, 1978

[51] Int. Cl.[3] ..... A63B 21/30

[52] U.S. Cl. ..... 272/68; 272/130; 273/DIG. 4

[58] Field of Search ..... 272/68, 67, 130, 143, 272/DIG. 1, DIG. 5, 116; 128/782, 774

[56] References Cited

U.S. PATENT DOCUMENTS

| | | | |
|---|---|---|---|
| 482,623 | 9/1892 | Dooling | 73/379 |
| 3,081,634 | 3/1963 | Blaszkowski | 73/379 |
| 3,658,326 | 4/1972 | Fawick | 272/68 |
| 3,756,084 | 9/1973 | Stambera | 73/379 |
| 3,898,983 | 8/1975 | Blam | 128/782 |
| 4,040,619 | 8/1977 | Landi | 272/68 |

*Primary Examiner*—Richard C. Pinkham
*Assistant Examiner*—William R. Browne
*Attorney, Agent, or Firm*—Geoffrey R. Myers

[57] ABSTRACT

A device is provided which helps rehabilitate and exercise the hand. In doing so, it indicates the progress being made, thus providing positive mental reinforcement, encouraging further improvement in the rehabilitation process. The device, which is blow molded from translucent plastic, includes a hollow conically shaped chamber having formed integrally therewith a handle and a bellows device connected via an orifice to the chamber. Fluid of a chosen color is provided in the chamber. Upon squeezing, the fluid is ejected in proportion to the force applied from the chamber into the bellows, thereby giving the patient a visual, positive indication of his progress. A series of devices requiring progressively increasing squeeze forces may be formed by using different fluids, conduit sizes and/or wall thicknesses. This provides a system for full rehabilitation. The handle is so located that even in the earliest stages of rehabilitation where the patient may not be able to hold onto the device itself, the device will be held on the hand.

7 Claims, 8 Drawing Figures

EXERCISER AND REHABILITATIVE GRIPPING DEVICE

Figure 3:
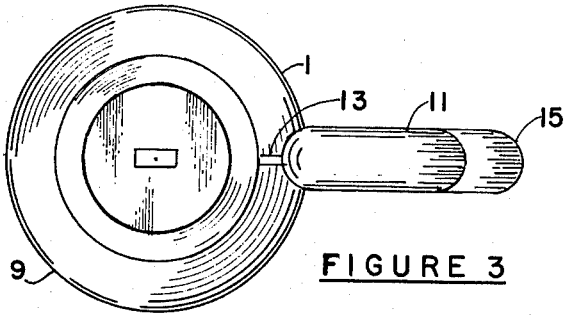

Hand exercisers, or other devices employing the use of the hand to squeeze a container and therey eject from the container a fluid, are well known. Some even have structures associated with them which measure the amount of fluid, etc., that is being expelled, thereby to indicate the relative pressure being applied to the device. These devices may be used merely. for fun and amusement, to build the strength of the hand and arms, or in the rehabilitation process. Exemplary of such devices are the following U.S. Patents:

U.S. Pat. No.
482,623
750,593
2,680,967
2,708,367
3,374,762
3,611,807
3,658,326
3,670,574
3,910,572

Generally speaking, these devices are of a somewhat complex nature, are not easily manufactured, may not be designed for rehabilitative purposes, do not provide sufficient positive mental reinforcement as increasing degrees of success are experienced, do not adequately accommodate all fingers for rehabilitation purposes, and/or do not retain the mechanism on the patient's hand in those instances where in the initial phases of rehabilitation he is not able to hold the device himself.

In view of the above, it is apparent that there exists a need in the art for a simple, easily manufactured and operated device for rehabilitation and hand exercise which is capable of being placed on the hand even though the hand may not be able to squeeze tightly enough to hold the device, which provides rehabilitating exercise and response for all fingers and which is effective to provide encouragement to go further with the rehabilitation process.

It is a purpose of this invention to fulfill this and other needs more apparent to the skilled artisan once given the following description of the invention.

Generally speaking, this invention fulfills these needs by providing a device for being gripped by a human hand and responding to the squeezing thereof by said hand, said device comprising: a substantially conically shaped hollow chamber, a hollow bellows, an orifice having one end in communication with said bellows and the other end in communication with said chamber, a handle means integrally associated with said conical chamber and adapted to retain said hand in proximate gripping location to said chamber even though the hand is not actually gripping said chamber, said chamber being capable of retaining an indicator liquid therein, said chamber having sufficiently flexible walls such that when gripped and squeezed by said hand with sufficient force, a liquid retained therein will flow from said chamber through said orifice and into said bellows in an amount and to a degree proportional to the amount of force applied by said hand.

By varying the wall thickness, orifice sizes, and/or the viscosity of the fluid in a plurality of devices the required squeeze pressure may be varied between devices. This results in an entire rehabilitation system which gives positive mental reinforcement for the entire rehabilitative process.

This invention will now be described with respect to certain embodiments thereof as illustrated in the accompanying drawings, wherein:

IN THE DRAWINGS

Figure 1:
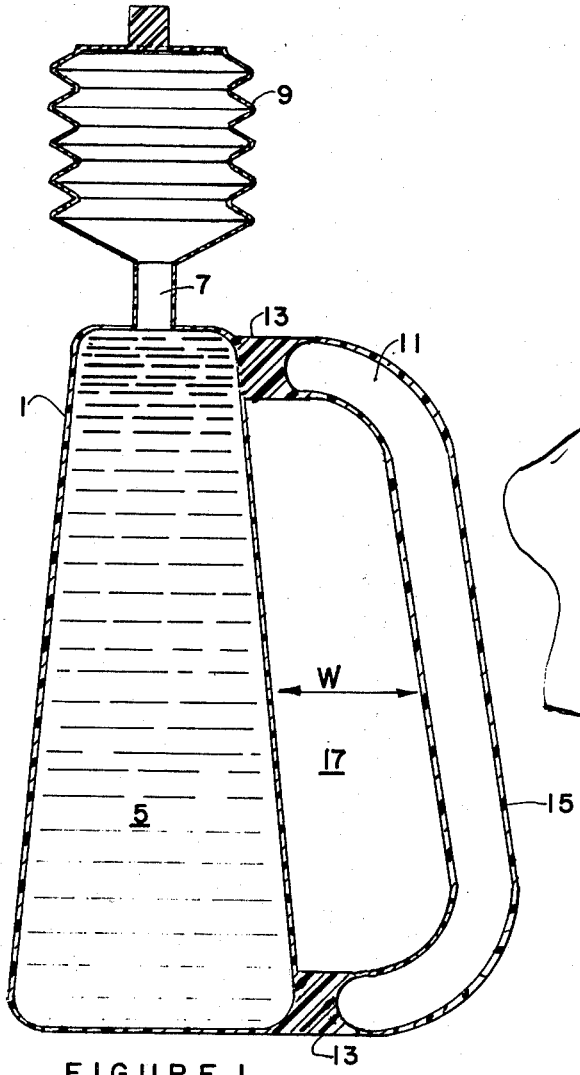
Figure 4:
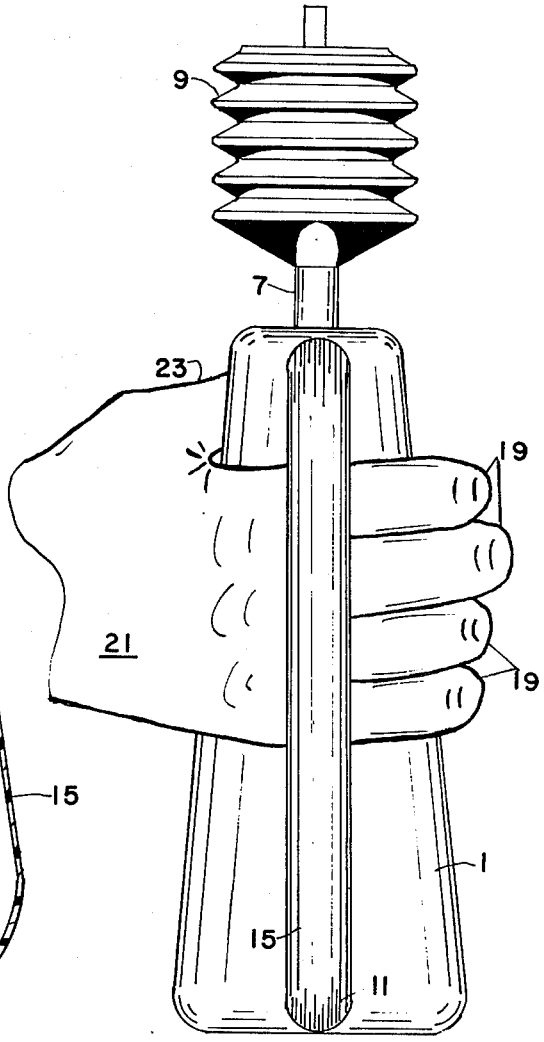
Figure 2:
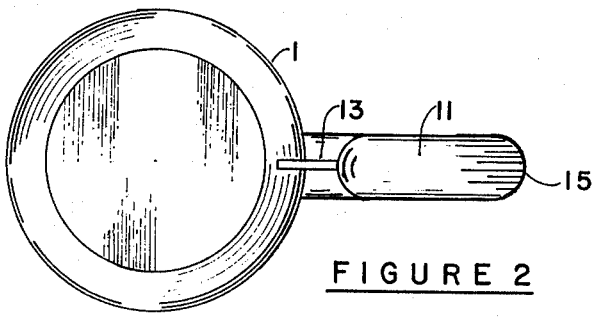
Figure 7:
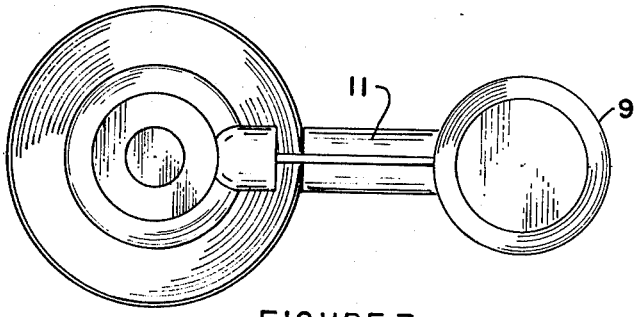
Figure 5:
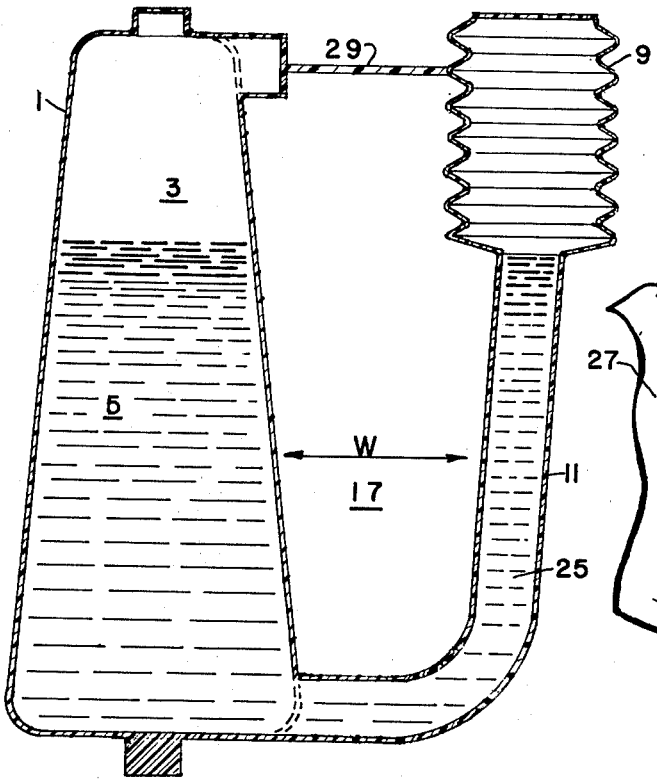
Figure 8:
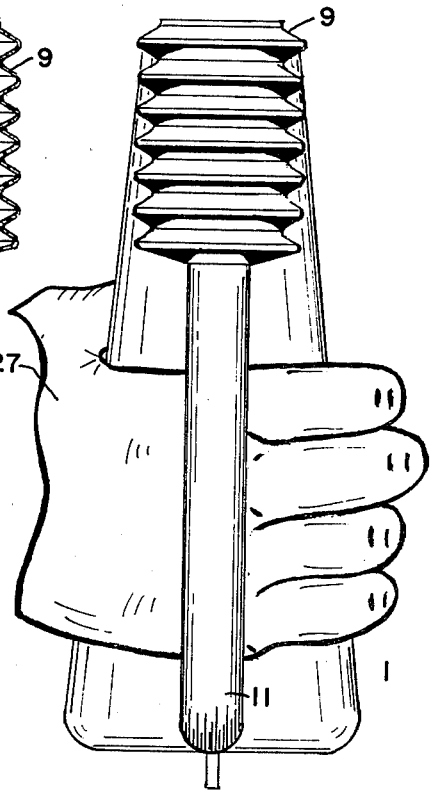
Figure 6:
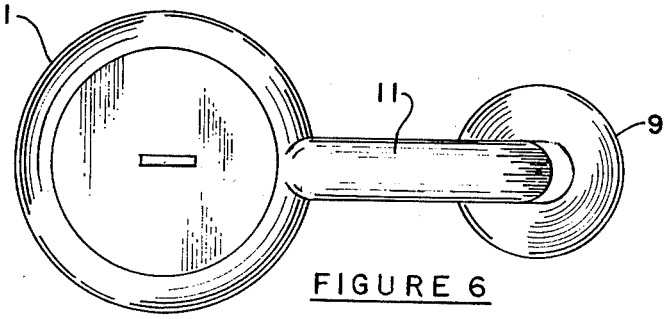

FIG. 1 is a side, partially sectionalized elevation view of an embodiment of this invention, FIG. 2 is a bottom plan view of the embodiment in FIG. 1, FIG. 3 is a top plan view of the embodiment in FIG. 1, FIG. 4 is a rear elevational view of the embodiment in FIG. 1 as it is being grasped for squeezing by a hand, FIG. 5 is a side, partially sectionalized, elevation view of another embodiment of this invention, FIG. 6 is a bottom plan view of the embodiment of FIG. 5, FIG. 7 is a top plan view of an embodiment in FIG. 5, and FIG. 8 is a rear elevational view of the embodiment of FIG. 5, being grasped for squeezing by a hand.

With reference to the embodiments in FIGS. 1–4, it is seen, particularly with respect to FIG. 1, that there is provided a generally conically shaped hollow container 1 having walls of a selected thickness thereby to form a chamber 3 in which there is located a liquid 5.

Integrally formed with container 1, via neck orifice 7, are expansion bellows 9. Integrally formed in the side of container 1 is u-shaped handle 11, pinched at points 13 so as to prevent fluid from flowing from chamber 3 into handle 11, when being squeezed by a hand. The unpinched portion 15 of handle 11 may be hollow or solid but preferably is hollow in order to insure lightness and comfort. The gap 17 formed between handle 11 and container 1 is of such a width "W" so as to provide a reasonably snug, but comfortable fit on the patient's hand with slight expansion outwardly of handle 11 so as to hold the device on the patient's hand even though he is incapable of wrapping his fingers around container 1 and holding it.

As best illustrated in FIG. 4, the four fingers 19 of the patient's hand 21 are placed through gap 17 and around container 1, with the thumb 23 going around the other side thereof. In this embodiment, the bellows are held in an upright position, the pinky being the lowermost finger 19 on the container position. As can be see, the downwardly diverging or conical shape of container 1 is important since it distributes involvement of all fingers substantially equally in the squeezing and thus, rehabilitation process.

As the patient begins the squeezing rehabilitative or exercising process, liquid 5, which may be a brightly colored liquid of a chosen viscosity (e.g., water at standard water viscosity using a red vegetable dye) will be expelled from the container through the orifice in neck 7 and into the bellows 9. As more pressure is applied, bellows 9 will expand because of the internal pressure above it, and more fluid will flow into the bellows, thereby giving the patient an immediate mental positive reinforcement to encourage him to go further to see if he or she can get more fluid into the container.

One of the benefits of the subject device, is that it is so effective in providing this advantageous positive mental reinforcement, yet is of simple one piece construction easily blow molded by conventional blow molding techniques. The thicknesses of the walls may be chosen, as may the orifice size in neck 7, the size of the bellows, and/or the viscosity of the fluid (all within the conventional expertise of the artisan) so as to provide a chosen "squeeze" force for the patient (e.g. easy, medium, or hard).

A typical example would be to blow mold the illustrated device from transparent or translucent polyethylene or polyvinylchloride, choosing the amount and thickness of the parison so as to provide a wall thickness of about 1/32 of an inch to about ¼ of an inch with a total weight of about 12–35 grams and the dimensions as illustrated to full scale. The viscosity of the fluid may then be chosen from a light, low viscosity fluid incorporating a colored dye of one color all the way up to a heavy viscosity fluid. The density of the plastic may also be varied (e.g. high or low density polyethylene. In such embodiments, the size of the orifice 7 may be maintained constant, or may be varied slightly as desired. Obviously, as the thickness of the walls in container 1 and the bellows are varied in the blow molding process, so generally will the orifice in neck 7. In this way a single device or a full range of devices with varying "squeeze" force requirements may be simply and effectively provided to the therapist for his use with the patient.

The embodiment illustrated in FIGS. 5–8 is similar to the device illustrated FIGS. 1–4 as discussed immediately above. In this embodiment, however, the bellows 9 are provided at the top of handle 11 which itself is hollow and forms a connecting orifice 25 with chamber 3 in container 1. The same width relationship is retained in gap 17 so that hand 27 is held to the device even though the patient cannot adequately hold the device for himself. Handle 11 is completed in u-shape by means 29 of solid construction. Since menas 29 is not hollow, it thereby does not connect chamber 3 to bellows 9 and fluid 5 cannot flow at this location.

The device shown in FIGS. 5–8 may be manufactured in the same way as the device shown in FIGS. 1–4, and the various parameters varied similarly so as to provide either a single device of chosen "squeeze" force or a full range of devices of varying "squeeze" forces for use over the entire or a selected portion of the rehabilitative process.

The actual mental reinforcement aspect of this device is simple and straight forward, and therein achieves its uniqueness and advantages over the prior art. A colored fluid moves when the translucent (or clear) plastic cone wall is squeezed. The bellows on the top of the chamber responds to the degree of pressure commensurate with the capabilities of the patient. At the beginning stage, accomplishment is shown by minor upward movement of a particularly colored fluid. This is an incentive to reach another level in the easily visible movement of the colored fluid. The bellows are of such a type, using conventional plastics, that this movement is easily seen even if there are sight limitations in the patient. There are no dials or charts to confuse the user, no language skills or reading ability necessary, making it universal in nature and as valuable an aid for the youngest user as for the oldest. Individuals with less severe disabilities can start the program in some intermediate stage. People seeking exercise, without need for rehabilitation may wish to start at the last stage.

The unique cone shape of the device accommodates the hand quite easily while the handle allows the device to rest on the patient's hand keeping it in correct position when even a minimal grasp is beyond the capability of the user. As previously stated, the conical shape serves to distribute involvement of all fingers including that of the annularis (middle) and minimus (little or pinky) fingers, making the rehabilitation procedure substantially equal for these fingers in a way not accomplished by the prior art devices.

The energy required to reach various stages may be easily calibrated into the invention as hereinabove described and the therapist, even at a considerable distance can view a patient and his progress. The device or system is equally good for in-patient or out-patient use as the therapist can establish specific and identifiable goals for the patient to work toward whether confined or at home.

Once given the above description, many other features, modification and improvements will become apparent to the skilled artisan. Such other features, modifications and improvements are therefore considered to be a part of this invention, the scope of which is to be determined by the following claims:

I claim:

1. A device for being gripped by a human hand and responding to the squeezing thereof by said hand, said device comprising a substantially conically shaped hollow chamber, a hollow bellows, an orifice having one end in communication with said bellows, and the other end in communication with said chamber, a handle means connected to said conical chamber and forming a closed space between the handle means and conical chamber, said space being of a size sufficient to retain a hand in proximate gripping location to said chamber even though the hand is not actually gripping said chamber, said chamber being capable of retaining an indicator liquid therein, said chamber having sufficiently flexible walls such that when gripped and squeezed by said hand with sufficient force, a liquid retained therein will flow from said chamber through said orifice and into said bellows in an amount and to a degree proportional to the amount of force applied by said hand.

2. A device according to claim 1 wherein said device is a blow molded integral one piece plastic unit formed of translucent material.

3. A device according to claim 2 wherein said device further includes an indication liquid located in said chamber, said bellows is expandable and retractable by said liquid flow, and said handle means is of a generally u-shape handle wherein the ends of the "u" are attached to a side wall of the conical chamber and said handle extends longitudinally in the direction of the center line of the conical chamber said "u-shape" defining a gap between said handle and said chamber into which a hand may be fit thereby to retain said device on said hand without said hand gripping said device.

4. A device according to claim 3 wherein said bellows is located at the smaller end of said conical chamber and said orifice extends as a neck from said smaller end of said conical chamber to one end of said bellows.

5. A device according to claim 4 wherein a portion intermediate the ends of the u-shaped handle is hollow and the ends thereof at the point of connection to said side wall are solid thereby to prevent passage of liquid into the hollow portion of said handle.

6. A device according to claim 3 wherein said bellows is located intermediate the ends of said u-shaped handle, said orifice extending from said chamber at one end of said u-shaped handle through a portion of said handle into communication with said bellows, the other end of said u-shaped handle being at the point of connection to said side wall thereby to prevent passage of liquid into or out of said chamber at this connection.

7. A device according to claim 6 wherein said bellows is located along that portion of the u-shaped handle which extends in a substantially parallel direction with the conical chamber, said orifice extending from a side wall of said chamber adjacent the larger end thereof and said portion of said handle being connected to a side wall of said chamber adjacent the smaller end thereof.

* * * * *